US011198491B2

(12) United States Patent
Kestin Cohen

(10) Patent No.: US 11,198,491 B2
(45) Date of Patent: Dec. 14, 2021

(54) SWIMMING BOARD

(71) Applicant: Myriam L. Kestin Cohen, Davie, FL (US)

(72) Inventor: Myriam L. Kestin Cohen, Davie, FL (US)

( * ) Notice: Subject to any disclaimer, the term of this patent is extended or adjusted under 35 U.S.C. 154(b) by 0 days.

(21) Appl. No.: 16/936,409

(22) Filed: Jul. 22, 2020

(65) Prior Publication Data

US 2021/0024181 A1 Jan. 28, 2021

Related U.S. Application Data

(60) Provisional application No. 62/877,156, filed on Jul. 22, 2019.

(51) Int. Cl.

| | |
|---|---|
| ***A63B 31/00*** | (2006.01) |
| ***B63B 32/73*** | (2020.01) |
| ***B63B 32/20*** | (2020.01) |
| ***B63C 9/13*** | (2006.01) |

(52) U.S. Cl.

CPC ..... *B63B 32/73* (2020.02); *A63B 31/00* (2013.01); *B63B 32/20* (2020.02); *B63C 9/13* (2013.01); *A63B 2208/03* (2013.01)

(58) Field of Classification Search

CPC ..... B63B 32/20; B63B 32/22; B63B 34/54; B63B 32/73

See application file for complete search history.

(56) References Cited

U.S. PATENT DOCUMENTS

| | | | | |
|---|---|---|---|---|
| 998,146 | A | 7/1911 | Alfier et al. | |
| 1,190,743 | A | 7/1916 | Fageol | |
| 2,042,152 | A | 5/1936 | Howland | |
| 5,569,057 | A * | 10/1996 | Barsdorf | B63B 32/00 441/65 |
| 6,334,799 | B1 * | 1/2002 | Delpozo | B63B 32/53 441/65 |
| 6,375,530 | B1 | 4/2002 | Earl | |
| 6,736,688 | B1 | 5/2004 | Garwood | |
| 10,293,898 | B2 * | 5/2019 | Villarreal | B63B 32/57 |
| 10,556,151 | B1 * | 2/2020 | Malykhin | B63C 11/46 |
| 2018/0141624 | A1 * | 5/2018 | Schroenn | B63C 11/49 |

* cited by examiner

*Primary Examiner* — Andrew Polay

(74) *Attorney, Agent, or Firm* — Mark C. Johnson; Johnson Dalal

(57) ABSTRACT

A swimming board having a buoyant board body having an upper surface defining, with a continuous body sidewall, a channel recessed into the board body and disposed proximal to the second end of the board body and having a strap fastening assembly coupled to the board body and with a groin strap and a waist strap that define apertures for receiving a user's legs and retaining the user to the board body.

20 Claims, 9 Drawing Sheets

110

SWIMMING BOARD

CROSS-REFERENCE TO RELATED APPLICATION

This application claims priority to U.S. Provisional Patent Application No. 62/877,156, filed Jul. 22, 2020, the entirety of the same is incorporated herein by reference.

FIELD OF THE INVENTION

The present invention relates generally to swimming aids, and, more particularly, relates to boards configured to at least partially support the weight of a user while swimming.

BACKGROUND OF THE INVENTION

Whether for sport, physical fitness, and/or recreation, a great number of individuals swim. For some individuals, however, swimming can be problematic without the assistance of a floatation device. Additionally, many users desire assistance in keeping their head above water or otherwise support for their body weight while swimming.

While there are known boards configured to support a user's body weight, they fail to do in a way that orients a user's body above water effectively, efficiently, and safely. Many known boards also fail to effectively allow a user to maneuver Additionally, known swimming boards fail to effectively couple to a user in an effective, efficient, and safe manner.

Therefore, a need exists to overcome the problems with the prior art as discussed above.

SUMMARY OF THE INVENTION

The invention provides a swimming board that overcomes the hereinafore-mentioned disadvantages of the heretofore-known devices and methods of this general type and that keeps a user's head above water while swimming.

Another object of the present invention is to enable users to effectively execute swimming styles, such as a breaststroke or freestyle, without getting the user's hair wet.

Another object of the present invention is to enable secure attachment of the swimming board while enabling effective and efficient movement of a user's arms and legs while swimming, thereby obviating the need for the user to wear a google, ear plugs, and/or a swimming cap.

Another object of the present invention is to enable swimmers to train and relax in an effective, efficient, and safe manner.

Another object of the present invention is to create a swimming board that is lightweight and low cost to manufacture, yet enables effective movement in a body of water and support for a user's body weight.

Another object of the present invention is to provide a comfortable support means for a user's body weight.

Another object of the present invention is to keep a user in a "V position" while utilizing the swimming board.

Another object of the present invention is to enable effective and efficient movement of the user and swimming board by providing multiple positions of the swimming board with respect to the user and placement of the user's head, namely chin, on the swimming board.

With the foregoing and other objects in view, there is provided, in accordance with the invention, a swimming board that includes a board body having a first end, a second end opposing the first end of the board body, a board length separating the first and second ends of the board body, two opposing sides defining a board width separating the two opposing sides and tapering toward the second end of the board body, an upper surface defining, with a continuous body sidewall, a channel recessed into the board body and disposed proximal to the second end of the board body, and a lower surface opposing the upper surface of the board body. The swimming board also includes a strap fastening assembly coupled to the board body and includes a groin strap with a first end, a second end opposing the first end of the groin strap, a groin strap length separating the first and second ends of the groin strap and extending from the first end of the board body and a waist strap with a first end, a second end opposing the first end of the waist strap, a waist strap length separating the first and second ends of the waist strap and extending to-and-from the two opposing sides of the board body to define a waist aperture, wherein the groin strap directly couples to the waist strap along the waist strap length to define two leg apertures.

In accordance with a further feature of the present invention, the board body is of a closed-cell foam material and with the upper surface of a deformably rigid material spanning the board length. Additionally, the continuous body sidewall and the channel span continuously from the first end 300 of the board body to the second end of the board body.

In accordance with another feature, an embodiment of the present invention includes the upper surface of the board body having a secondary channel sub-recessed into the board body below the channel and disposed proximal to the second end of the board body.

In accordance with another feature of the present invention, the secondary channel spans less than 25% of the board length.

In accordance with a further feature of the present invention, the lower surface defines a raised blade portion tapering in height laterally in opposing directions toward each of the respective two opposing sides of the board body, the raised blade portion substantially spanning the board length.

In accordance with yet another feature, an embodiment of the present invention also includes the board body having two arcuate surfaces disposed at the first end of the board body in an adjacent configuration.

In accordance with an exemplary feature, an embodiment of the present invention also includes the board body having a waste strap channel defined within the board body, spanning the board width, and terminating at two waste strap channel entrance apertures, the waste strap channel and the two waste strap channel entrance apertures having the waist strap spanning therethrough and a groin strap channel defined within the board body and spanning inwardly from the first end of the board body, wherein the groin strap channel has the groin strap disposed therein.

In accordance with an additional feature of the present invention, the groin strap channel terminates at the waste strap channel and the first end of the groin strap directly coupled to the waist strap along the waist strap length.

In accordance with a further feature of the present invention, the waist aperture and the two adjust leg apertures are selectively adjustable with a plurality of adjustment clips slidably coupled to the groin strap and the waist strap, respectively.

In accordance with an additional feature, an embodiment of the present invention also includes the first end of the groin strap having a loop formed thereon, wherein the loop has the waist strap slidably couplable therein.

Also in accordance with the present invention, a swimming board is disclosed that includes a board body of a closed-cell foam material and that has a first end defining a groin strap entrance aperture thereon, a second end opposing the first end of the board body, a board length separating the first and second ends of the board body, and two opposing sides defining a board width separating the two opposing sides. The board body also defines two waste strap channel entrance apertures and a waste strap channel defined within the board body, spanning the board width, and terminating at the two waste strap channel entrance apertures, and defines a groin strap channel defined within the board body and spanning inwardly from the first end of the board body. The board body also has an upper surface and a lower surface opposing the upper surface of the board body and a strap fastening assembly coupled to the board body. The strap fastening assembly includes a groin strap with a first end, a second end opposing the first end of the groin strap, a groin strap length separating the first and second ends of the groin strap and spanning through the groin strap channel and includes a waist strap with a first end, a second end opposing the first end of the waist strap, a waist strap length separating the first and second ends of the waist strap and spanning through the waste strap channel and the two waste strap channel entrance apertures, and extending to-and-from the two opposing sides of the board body to define a waist aperture, wherein the groin strap directly coupled to the waist strap along the waist strap length to define two leg apertures.

Although the invention is illustrated and described herein as embodied in a swimming board, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the board body, spanning in a direction from the first end to the second end thereof.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
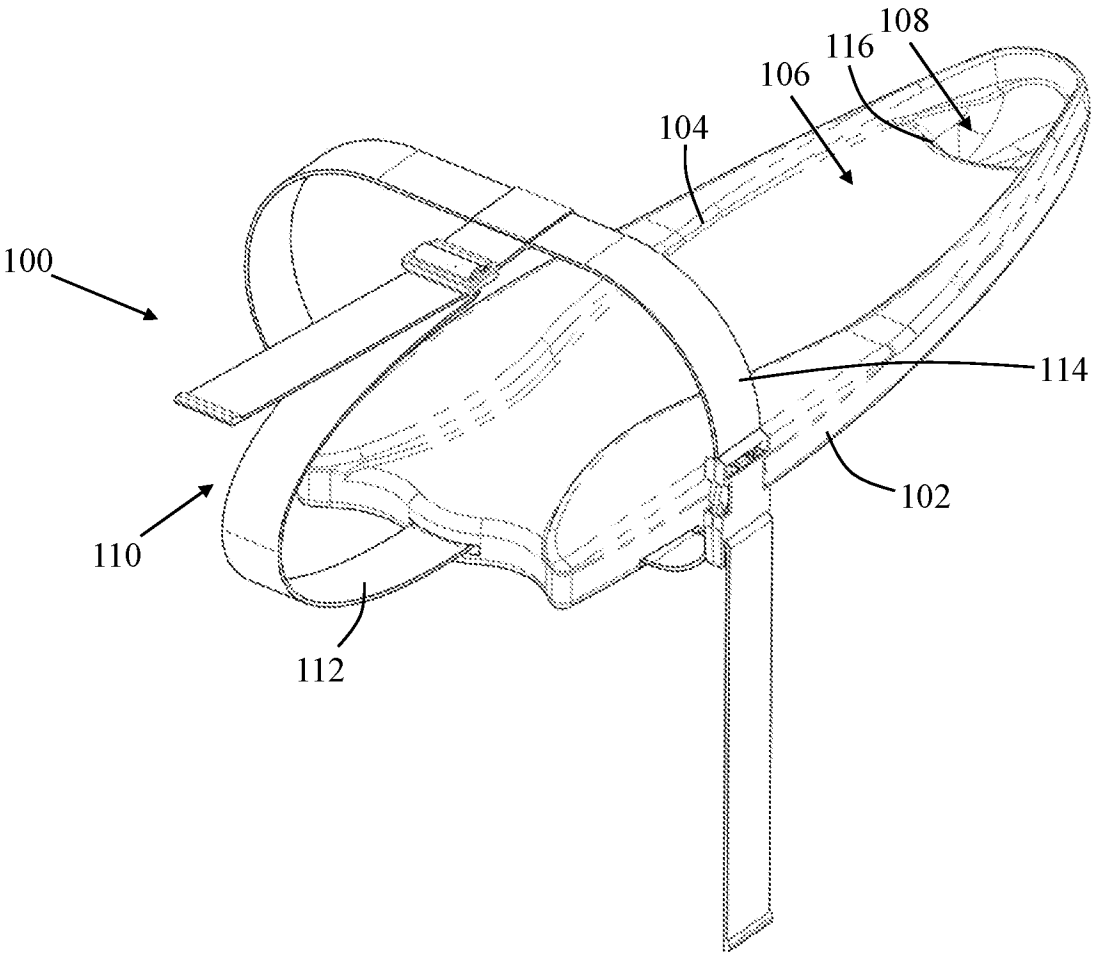
FIG. 1 is a perspective view of a swimming board in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a swimming board that accomplishes the above-described objectives in an efficient and effective manner not accomplished with known swimming aids. Referring now to FIGS. 1-4, one embodiment of the present invention is shown in various views. The figures depicted herein show several advantageous features of the present invention, but, as will be described below, the invention can be provided in several shapes, sizes, combinations of features and components, and varying numbers and functions of the components. The first example of a swimming board 100, however, includes a board body 102 and a strap fastening assembly 110 configured to retain the board body 102 to the user (as best seen depicted in FIG. 2).

The board body 102 includes a first end 300, a second end 302 opposing the first end 300 of the board body 102, a board length 304 separating the first and second ends 300, 302 of the board body 102, and two opposing sides 308, 310 defining a board width 600 (depicted in FIG. 6) separating the two opposing sides 308, 310. In one embodiment, the board length 304 is approximately 25-35 inches, the board width 600 is approximately 5-15 inches, and the height of the board may be no more than 3-5 inches, while in other embodiments the board length 304 and board width 600 are outside of said ranges, but of a distance sufficient to enable a user to swim uninterrupted and/or uninhibited. To that end, the two opposing sides 308, 310 may taper in board width 600 toward the second end 302 of the board body 102 to enable uninterrupted and/or uninhibited movement of a user's arms while swimming. In one embodiment, the two opposing sides 308, 310 may continuously taper in board width 600 until reaching the second end 302 of the board body 102 (as shown in the figures).

Additionally, the upper surface 306 may define, with a continuous body sidewall 104 on the board body 102, a channel 106 recessed into the board body 102 and disposed proximal to the second end 302 of the board body 102. Said differently, the channel 106 may be at least partially disposed at or near (within 25% of the overall board length 304) the second end of the second end 302 of the board body 102. As used herein, the term "wall" is intended broadly to encompass continuous structures, as well as, separate structures that are coupled together so as to form a substantially continuous external surface. The channel 106 may be recessed approximately 1-2 inches with respect to the uppermost surface of the board body 102 and beneficially serves either as a cavity to rest a user's chin while swimming and/or spacing to distance the user's torso from the upper surface 306 defining the channel 106 (if the channel 106 substantially the entire length of the board length 304).

In preferred applications of the present invention, the second end 302 will be placed approximately at and below a user's forehead. However, the board body 102 may be selectively placed at different locations with respect to the user so that it is most comfortable to the user. The strap fastening assembly 110 enables the user to adjust the straps 112, 114 thereon to loosen and tighten the board body 102 at said desired position with respect to the user. When desired for use in swimming, the user should strive to keep his or her body in a "V position" while swimming and do not push his or her upper body onto a position parallel to the water. Said another way, the configuration of the board body 102 beneficially enables the user to keep his or her body at an angle that is not parallel to the top surface of the water.

Figure 4:
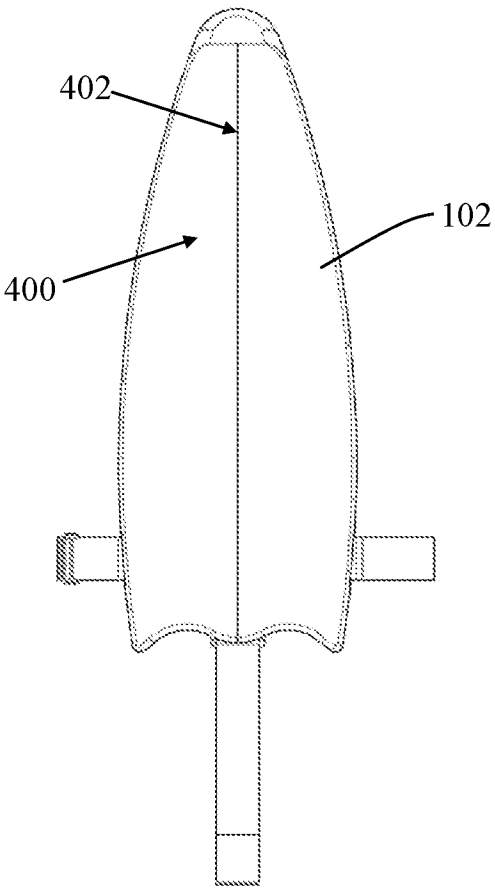
FIG. 4 is a bottom plan view of the swimming board in FIG. 1.
Figure 3:
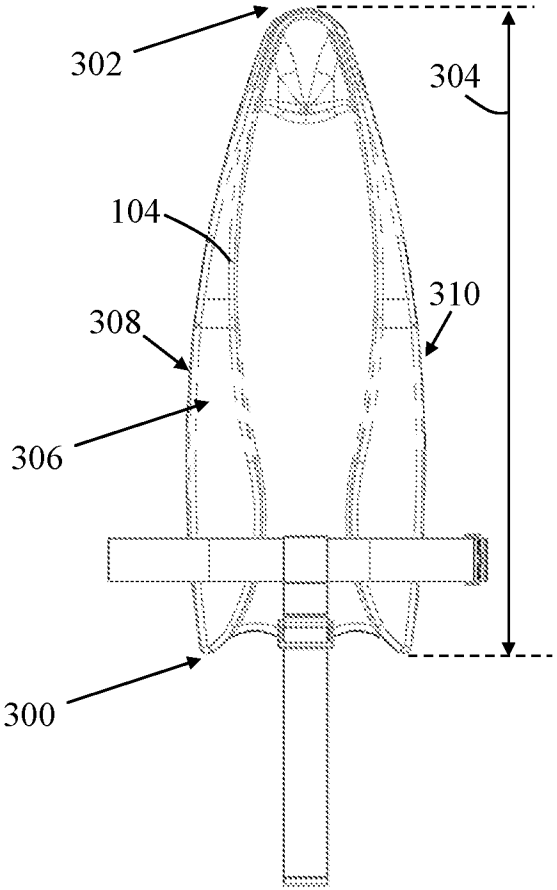
FIG. 3 is a top plan view of the swimming board in FIG. 1.
Figure 5:
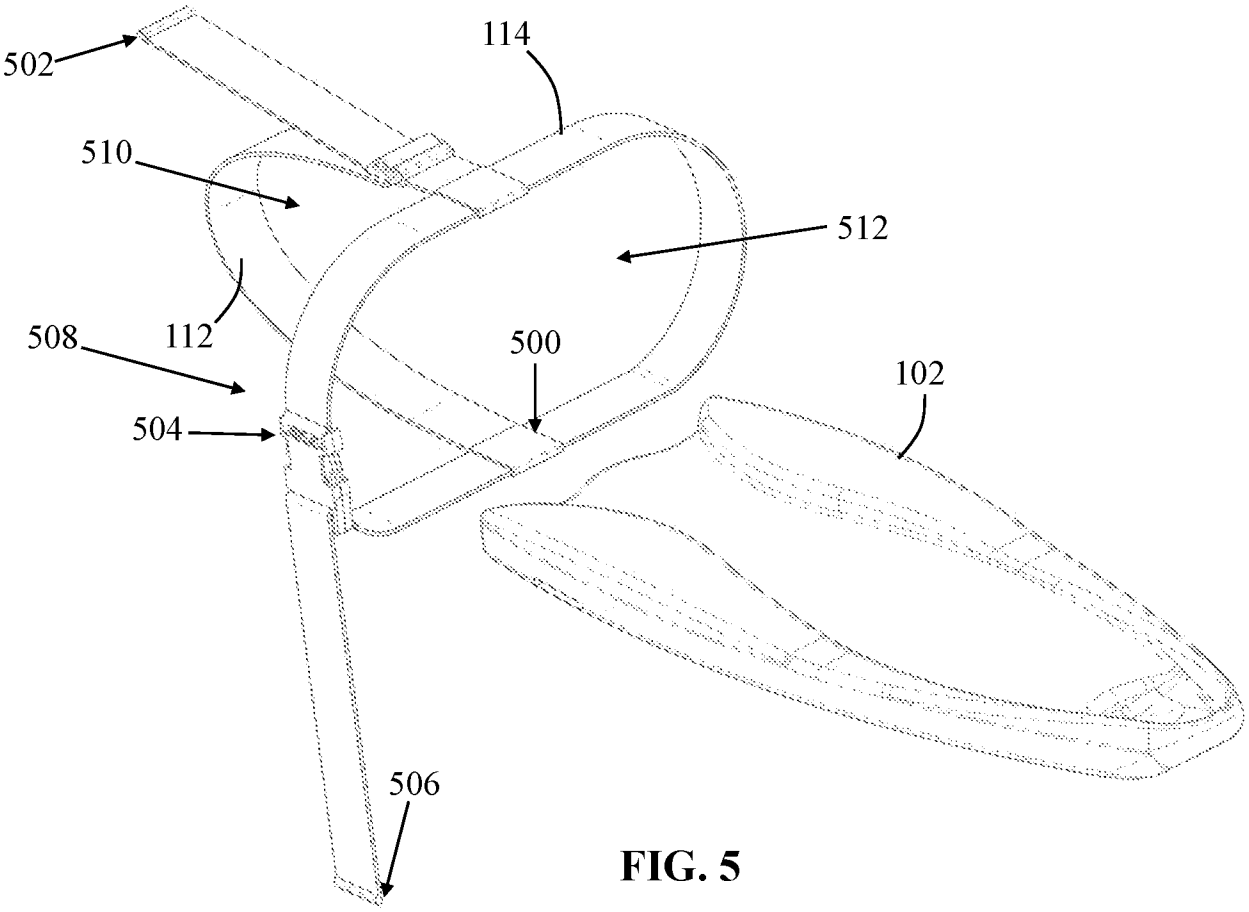
FIG. 5 is a perspective view of a strap fastening assembly uncoupled with a board body in accordance with one embodiment of the present invention.
Figure 6:
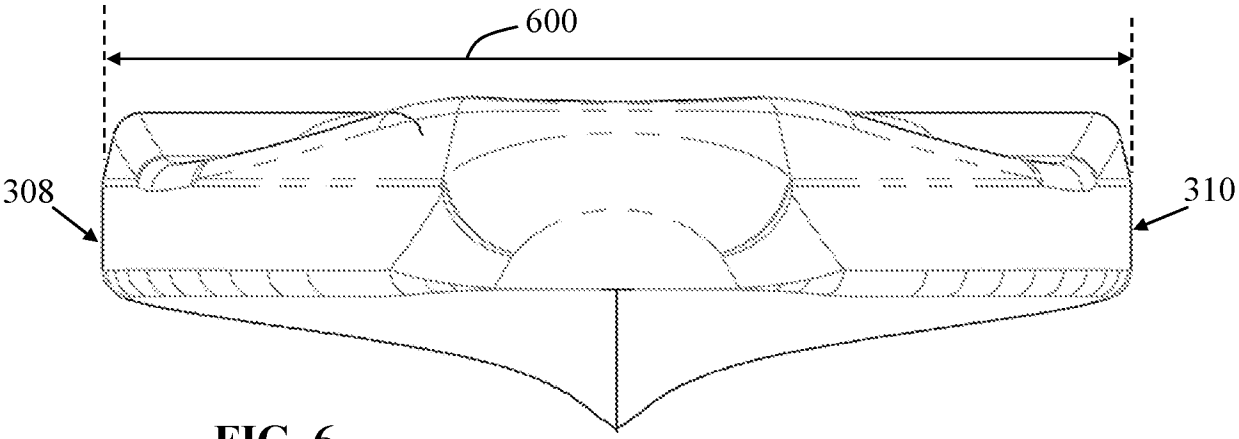
FIG. 6 is an elevational front view of the board body in FIG. 1 in accordance with one embodiment of the present invention.
Figure 7:
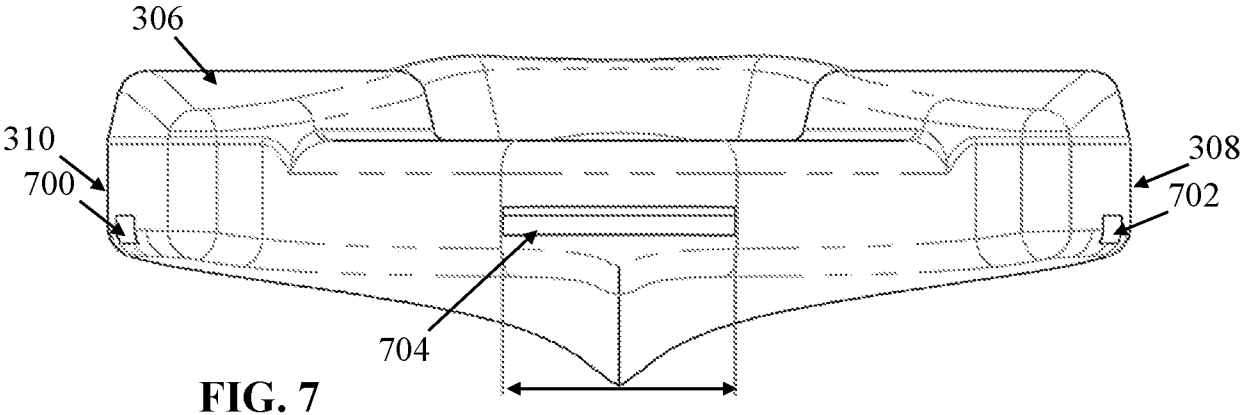
FIG. 7 is an elevational rear view of the board body in FIG. 1 in accordance with one embodiment of the present invention.

As best seen in FIG. 4 and FIGS. 6-7, the board body 102 can also be seen having a lower surface 400 opposing the upper surface 306 of the board body 102. The lower surface 400 may also beneficially define a raised blade portion 402 tapering in height laterally in opposing directions toward each of the respective two opposing sides 308, 310 of the board body 102. The raised blade portion 402 may also substantially span the board length 304 and enables the board body 102 to effectively travel through a body of water.

The aforementioned dimensions and shape of the board body 102 enable the board body 102 to be handheld and utilized by the user without substantially affecting and/or inhibiting a user's swimming motion. The board body 102 may also be of a closed-cell polymeric foam material (e.g., EVA foam) to effectuate generating a buoyancy effect. The upper surface 306 of the board body 102 may also be of a deformably rigid material (e.g., EVA foam) spanning the board length 304 for comfortability of the user.

With reference back to FIG. 1, the body sidewall 104 may be continuous (as depicted in the figures) and the channel 106 may span continuously and substantially from the first end 300 of the board body 102 to the second end 302 of the board body 102. As such, the raised sidewall 104 beneficially displaces a user's torso from the upper surface 306 of the board body 102 defining the channel 106. The displacement may, among other benefits, prevent the user from experiencing too much compression forces on his or her chest. In one embodiment, the upper surface 306 of the board body 102 also defines a secondary channel 108 sub-recessed (e.g., approximately 0.5-2 inches) into the board body 102 and below the channel 106. The secondary channel 108 may also be disposed proximal to the second end 302 of the board body 102. Said differently, the channel 106 may form just the recess where a user can place his or her chin while swimming, while in other embodiments, the channel 106 may include the second channel 108 defined therein and disposed for placement of the user's chin.

Figure 10:
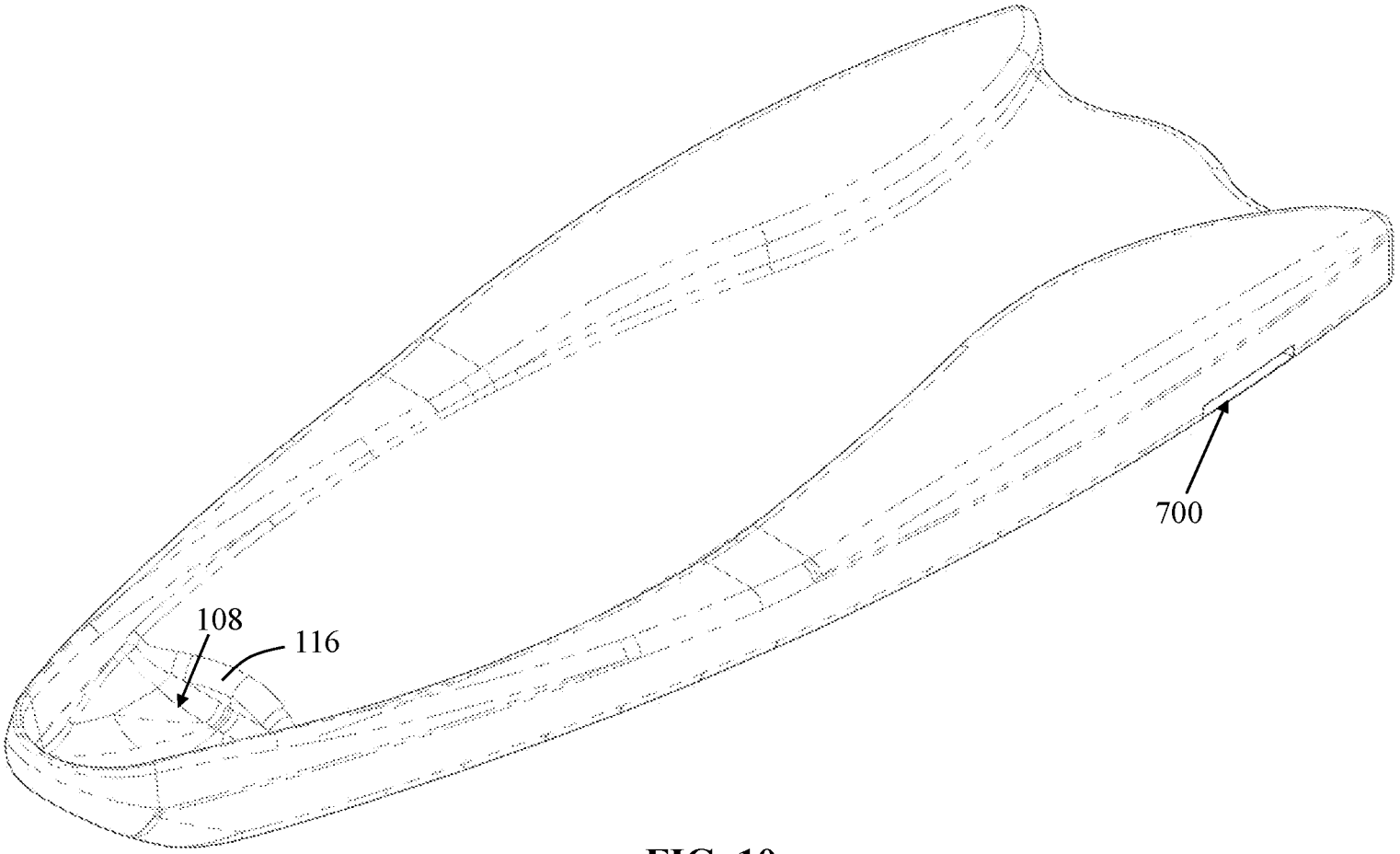
FIG. 10 is a perspective view of the board body in FIG. 1 in accordance with one embodiment of the present invention.
Figure 11:
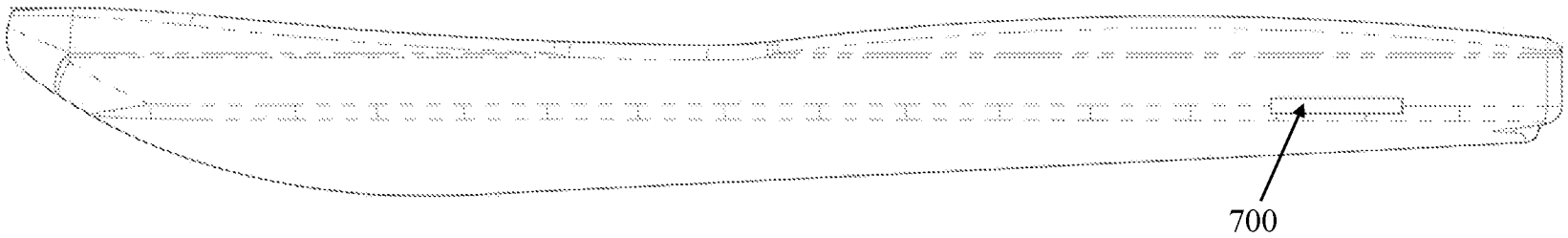
FIG. 11 is a perspective view of the board body in FIG. 1 in accordance with one embodiment of the present invention.

The secondary channel 108 may be defined and enclosed by a secondary body sidewall 116 and the body sidewall 104. The secondary body sidewall 116 may also include an arcuate portion (as best seen in FIG. 10) to retain a user's head thereon in a safe and comfortable position. In another embodiment of the present invention, the secondary channel 108 spans less than 25% of the board length 304 and may be sized and shaped to receive just a portion of a user's chin in a frictionally retained position. The channel 106 and/or secondary channel 108 also beneficially enables a user to keep his or her head steady while utilizing the board 100, thereby not requiring a user to rotate his or her body from side-to-side to breathe (as is typically required for swimming freestyle). Keeping a user's head still also prevents the board body 102 from slipping off the user.

Figure 8:
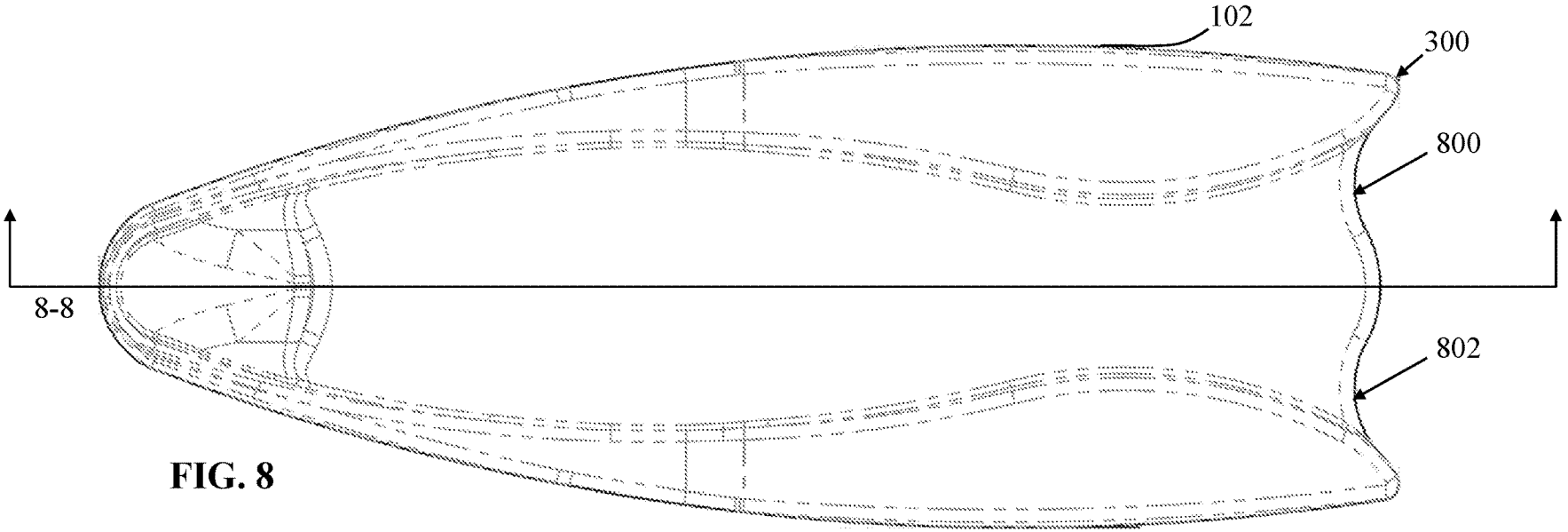
FIG. 8 is a top plan view of the board body in FIG. 1 in accordance with one embodiment of the present invention.
Figure 9:
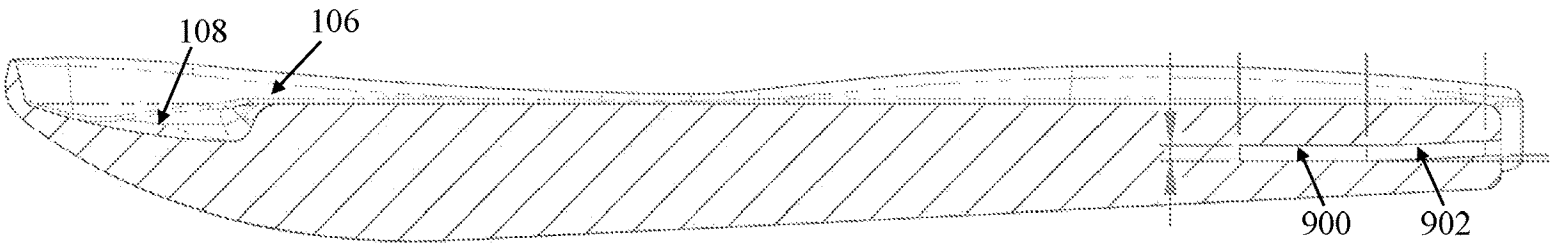
FIG. 9 is a cross-sectional view of the board body in FIG. 8 along section line 8-8 in accordance with one embodiment of the present invention.

Beneficially and as best seen in FIG. 8, the board body 102 may also define two arcuate surfaces 800, 802 thereon and disposed at the first end 300 of the board body 102 in an adjacent configuration. The two arcuate surfaces 800, 802 provide a location to place a user's legs while utilizing the board body 102 and to move a user's legs uninhibited and/or with minimal interference from the board body 102.

Figure 2:
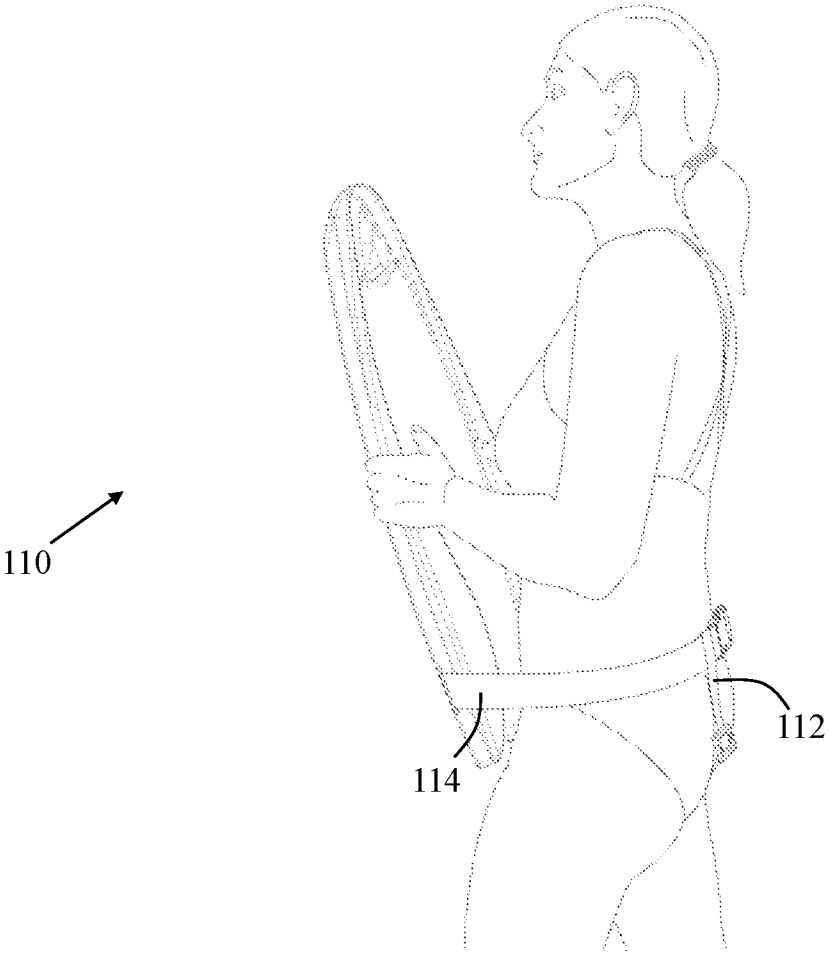
FIG. 2 is a perspective view of the swimming board in FIG. 1 coupled to a user in accordance with one embodiment of the present invention.
Figure 12:
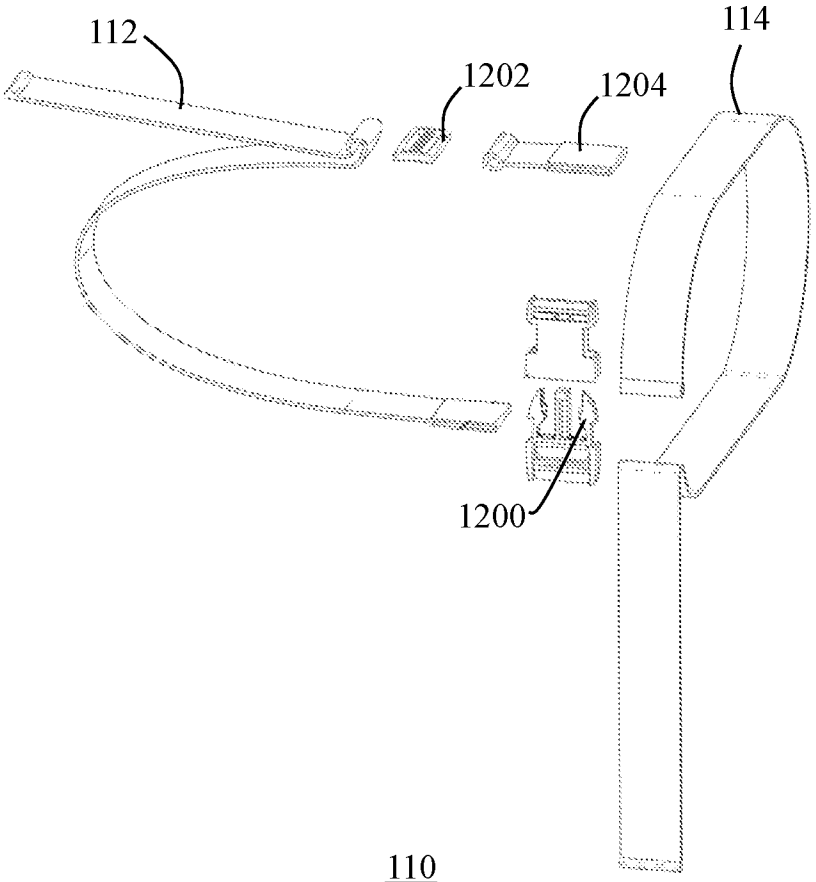
FIG. 12 is an exploded view of the strap fastening assembly in FIG. 1 in accordance with one embodiment of the present invention.

With reference now to FIGS. 1-2 and FIG. 12, the strap fastening assembly 110 may be coupled to the board body 102 and includes a groin strap 112 and a waist strap 114 that may be of a waterproof and durable material, e.g., a polymeric material such polypropylene. The groin strap 112, which is configured for placement underneath or about a user's groin area, includes a first end 500, a second end 502 opposing the first end 500 of the groin strap 112, a groin strap length separating the first and second ends 500, 502 of the groin strap 112 and extends from the first end 300 of the board body 102. The waist strap 114 includes a first end 504, a second end 506 opposing the first end 504 of the waist strap 114, a waist strap length separating the first and second ends 504, 506 of the waist strap 114 and may extend to-and-from the two opposing sides 308, 310 of the board body 102 to define a waist aperture 512. The groin strap 112 may be directly coupled to the waist strap 114 along the waist strap length to define two leg apertures 508, 510. The waist aperture 512 and leg apertures 508, 510 enable the user to insert his or her waist and legs therein when desired for use (as seen in FIG. 2). The user will tighten one or more of the straps 112, 114 when placed at the desired position, thereby compressing the waist strap 114 and board body 102 against the user. In one embodiment, the user will tighten both straps 112, 114, but in other embodiments the groin or center strap may be left loose for comfort of the user and to prevent the user from slipping through the waist strap 114.

With reference to FIG. 7 and FIGS. 9-12, a waste strap channel 900 may be defined within the board body 102 and that spans the board width 600 until terminating at two waste strap channel entrance apertures 700, 702 that may be disposed on the sides 308, 310 of the board body 102. The waste strap channel 900 and the two waste strap channel entrance apertures 700, 702 may have the waist strap 114 spanning therethrough. A groin strap channel 902 may also be defined within the board body 102 and spanning inwardly from an entrance aperture 704 first end 300 of the board body 102. The groin strap channel 900 may also have the groin strap 112 disposed therein. The apertures 700, 702, 704 and channels 900, 902 may be formed by through the molding process and/or by milling out portions of the board body 102 to the desired distance. In other embodiments, however, the straps 112, 114 may be adhered or otherwise fastened to the board body 102 and still effectuate the strap configuration depicted in the figures.

In one embodiment, the groin strap channel 902 terminates at the waste strap channel 900 and the first end 500 of the groin strap 112 is directly coupled to the waist strap 114 along the waist strap length. Additionally, the waist aperture 512 and the two adjust leg apertures 508, 510 are selectively adjustable with one or more adjustment clips 1200, 1202 (e.g., an adjustment clip, webbing clip, or other connector). As depicted best in FIG. 12, the adjustment clips 1200, 1202 may be slidably coupled to the groin strap 112 and the waist strap 114, respectively. Further, the first end 500 of the groin strap 112 may also include a loop 1204 formed thereon, wherein the loop 1204 has the waist strap 114 slidably couplable therein. As such, strap assembly 110 depicted in FIG. 12 enables a low-cost, yet reliable, method of effectively coupling the board body 102 to the user without fastening or adhering the straps 112, 114 to the board body 102 (that are prone to failure and/or discomfort to the user while utilizing the board).

Although a specific order of executing process steps has been disclosed, the order of executing the steps may be changed relative to the order shown in certain embodiments. Also, two or more steps described as occurring in succession may be executed concurrently or with partial concurrence in some embodiments. Certain steps may also be omitted for the sake of brevity. In some embodiments, some or all of the process steps can be combined into a single process.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A swimming board comprising:

a board body having a first end, a second end opposing the first end of the board body, a board length separating the first and second ends of the board body, two opposing sides defining a board width separating the two opposing sides and tapering toward the second end of the board body, an upper surface defining, with a continuous body sidewall, a channel recessed into the board body and disposed proximal to the second end of the board body, and a lower surface opposing the upper surface of the board body and defining a raised blade portion tapering in height laterally in opposing directions toward each of the respective two opposing sides of the board body, the raised blade portion substantially spanning the board length; and a strap fastening assembly coupled to the board body and including:

a groin strap with a first end, a second end opposing the first end of the groin strap, a groin strap length separating the first and second ends of the groin strap and extending from the first end of the board body; and a waist strap with a first end, a second end opposing the first end of the waist strap, a waist strap length separating the first and second ends of the waist strap and extending to-and-from the two opposing sides of the board body to define a waist aperture, the groin strap directly coupled to the waist strap along the waist strap length to define two leg apertures.

2. The swimming board according to claim 1, wherein:

the board body is of a closed-cell foam material and with the upper surface of a deformably rigid material spanning the board length.

3. The swimming board according to claim 1, wherein:

the continuous body sidewall and the channel span continuously from the first end 300 of the board body to the second end of the board body.

4. The swimming board according to claim 3, wherein the upper surface of the board body further defines:

a secondary channel sub-recessed into the board body below the channel and disposed proximal to the second end of the board body.

5. The swimming board according to claim 4, wherein:

secondary channel spans less than 25% of the board length.

6. The swimming board according to claim 1, wherein the board body further comprises:

two arcuate surfaces disposed at the first end of the board body in an adjacent configuration.

7. The swimming board according to claim 1, wherein board body further comprises:

a waste strap channel defined within the board body, spanning the board width, and terminating at two waste strap channel entrance apertures, the waste strap channel and the two waste strap channel entrance apertures having the waist strap spanning therethrough; and a groin strap channel defined within the board body and spanning inwardly from the first end of the board body, the groin strap channel having the groin strap disposed therein.

8. The swimming board according to claim 7, wherein:

the groin strap channel terminates at the waste strap channel and the first end of the groin strap directly coupled to the waist strap along the waist strap length.

9. The swimming board according to claim 8, wherein:

the waist aperture and the two adjust leg apertures are selectively adjustable with a plurality of adjustment clips slidably coupled to the groin strap and the waist strap, respectively.

10. The swimming board according to claim 8, wherein the first end of the groin strap further comprises:

a loop formed thereon, the loop having the waist strap slidably couplable therein.

11. A swimming board comprising:

a board body of a closed-cell foam material and:

having a first end defining a groin strap entrance aperture thereon, a second end opposing the first end of the board body, a board length separating the first and second ends of the board body, and two opposing sides defining a board width separating the two opposing sides;

defining two waste strap channel entrance apertures and a waste strap channel defined within the board body, spanning the board width, and terminating at the two waste strap channel entrance apertures;

defining a groin strap channel defined within the board body and spanning inwardly from the first end of the board body; and an upper surface and a lower surface opposing the upper surface of the board body; and a strap fastening assembly coupled to the board body and including:

a groin strap with a first end, a second end opposing the first end of the groin strap, a groin strap length separating the first and second ends of the groin strap and spanning through the groin strap channel; and a waist strap with a first end, a second end opposing the first end of the waist strap, a waist strap length separating the first and second ends of the waist strap and spanning through the waste strap channel and the two waste strap channel entrance apertures, and extending to-and-from the two opposing sides of the board body to define a waist aperture, the groin strap directly coupled to the waist strap along the waist strap length to define two leg apertures.

12. The swimming board according to claim 11, wherein:

the board width tapers toward the second end of the board body.

13. The swimming board according to claim 11, wherein the upper surface of the board body further comprises:

a continuous body sidewall defining a channel recessed into the board body and disposed proximal to the second end of the board body.

14. The swimming board according to claim 13, wherein:

the continuous body sidewall and the channel span continuously from the first end of the board body to the second end of the board body.

15. The swimming board according to claim 14, wherein the upper surface of the board body further defines:

a secondary channel sub-recessed into the board body below the channel and disposed proximal to the second end of the board body.

16. The swimming board according to claim 11, wherein board body further comprises:

two arcuate surfaces disposed at the first end of the board body in an adjacent configuration.

17. The swimming board according to claim 11, wherein:

the groin strap channel terminates at the waste strap channel and the first end of the groin strap directly coupled to the waist strap along the waist strap length.

18. The swimming board according to claim 17, wherein:

the waist aperture and the two adjust leg apertures are selectively adjustable with a plurality of adjustment clips slidably coupled to the groin strap and the waist strap, respectively.

19. A swimming board comprising:

a board body having a first end, a second end opposing the first end of the board body, a board length separating the first and second ends of the board body, two opposing sides defining a board width separating the two opposing sides and tapering toward the second end of the board body, an upper surface defining, with a continuous body sidewall, a channel recessed into the board body and disposed proximal to the second end of the board body, two arcuate surfaces disposed at the first end of the board body in an adjacent configuration, and a lower surface opposing the upper surface of the board body; and a strap fastening assembly coupled to the board body and including:

a groin strap with a first end, a second end opposing the first end of the groin strap, a groin strap length separating the first and second ends of the groin strap and extending from the first end of the board body; and a waist strap with a first end, a second end opposing the first end of the waist strap, a waist strap length separating the first and second ends of the waist strap and extending to-and-from the two opposing sides of the board body to define a waist aperture, the groin strap directly coupled to the waist strap along the waist strap length to define two leg apertures.

20. A swimming board comprising:

a board body having a first end, a second end opposing the first end of the board body, a board length separating the first and second ends of the board body, two opposing sides defining a board width separating the two opposing sides and tapering toward the second end of the board body, an upper surface defining, with a continuous body sidewall, a channel recessed into the board body and disposed proximal to the second end of the board body, a waste strap channel defined within the board body, spanning the board width, and terminating at two waste strap channel entrance apertures, a groin strap channel defined within the board body and spanning inwardly from the first end of the board body, and a lower surface opposing the upper surface of the board body; and a strap fastening assembly coupled to the board body and including:

a groin strap with a first end, a second end opposing the first end of the groin strap, a groin strap length separating the first and second ends of the groin strap and extending from the first end of the board body, the waste strap channel and the two waste strap channel entrance apertures having the waist strap spanning therethrough; and a waist strap with a first end, a second end opposing the first end of the waist strap, a waist strap length separating the first and second ends of the waist strap and extending to-and-from the two opposing sides of the board body to define a waist aperture, the groin strap directly coupled to the waist strap along the waist strap length to define two leg apertures and the groin strap channel having the groin strap disposed therein.

* * * * *